United States Patent [19]

Maskasky

[11] Patent Number: 4,713,320

[45] Date of Patent: Dec. 15, 1987

[54] LOW METHIONINE GELATINO-PEPTIZER TABULAR GRAIN SILVER BROMIDE AND BROMOIODIDE EMULSIONS AND PROCESSES FOR THEIR PREPARATION

[75] Inventor: Joe E. Maskasky, Rochester, N.Y.

[73] Assignee: Eastman Kodak Company, Rochester, N.Y.

[21] Appl. No.: 15,270

[22] Filed: Feb. 17, 1987

Related U.S. Application Data

[63] Continuation of Ser. No. 811,133, Dec. 19, 1985, abandoned.

[51] Int. Cl.[4] ..... G03C 1/02; G03C 5/26

[52] U.S. Cl. ..... 430/567; 430/434; 430/495; 430/496; 430/564; 430/569

[58] Field of Search ..... 430/567, 569, 495, 496, 430/564, 434

[56] References Cited

U.S. PATENT DOCUMENTS

| | | | |
|---|---|---|---|
| 2,890,215 | 6/1959 | Corben | 430/642 X |
| 4,434,226 | 2/1984 | Wilgus et al. | 430/569 X |
| 4,520,098 | 5/1985 | Dickerson | 430/292 |

FOREIGN PATENT DOCUMENTS

| | | |
|---|---|---|
| 1449902A | 6/1985 | European Pat. Off. . |
| 58-70221 | 4/1983 | Japan . |
| 59-195232 | 11/1984 | Japan . |
| 245456 | 6/1925 | United Kingdom . |

OTHER PUBLICATIONS

Mol, "Investigations of Oxidized Gelatins", 2nd Photographic Gelatin Symposium, sponsored by the Royal Photographic Society, Oxford, U.K. Sep. 6, 1985.

*Research Disclosure,* vol. 176, Dec. 1978, Item 17643.

*Research Disclosure,* vol. 225, Jan. 1987, Item 22534.

J. Pouradier and Annette Rondeau, "On the Methionine Sulphoxide of Gelatin", The Journal of Photographic Science, vol. 16, 1968, pp. 68 and 69.

Y. Matsuo "Degradation of Methionine by Hydrogen Peroxide", *Nature,* vol. 171, p. 1021, 1953.

J. Beersman, "Proceedings of the International Colloquium Held at Liege 1959", *Scientific Photography,* Macmillan, pp. 321 and 322.

W. D. Kelly, "Purification and Chemical Sensitization of Photographic Gelatin," *The Journal of Photographic Science,* vol. 6, pp. 16–22, 1958.

*Primary Examiner*—John E. Kittle

*Assistant Examiner*—Mukund J. Shah

*Attorney, Agent, or Firm*—Carl O. Thomas

[57] ABSTRACT

The present invention is directed to a process of precipitating for use in photography a thin, tabular grain silver bromide or bromoiodide emulsion employing a gelatino-peptizer comprised of less than 30 micromoles of methionine per gram and to an emulsion produced by this process. A variety of advantages can be realized, including a wider range of permissible bromide ion concentrations during precipitation, thinner and/or larger diameter tabular grains, a reduced rod population, and novel tabular grain forms.

18 Claims, 10 Drawing Figures

FIG. 1
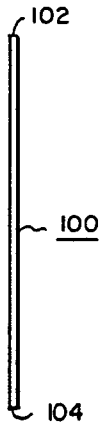
FIG. 2
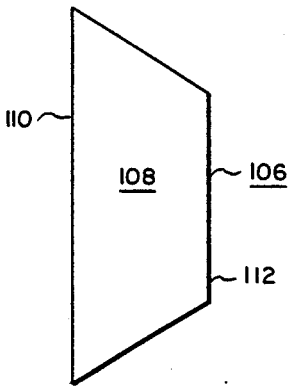
FIG. 3
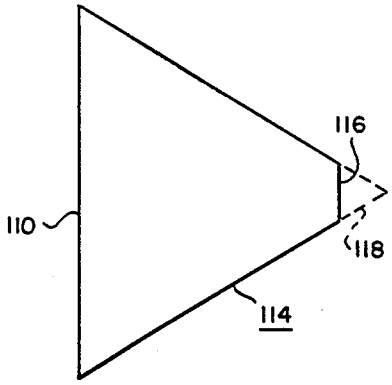
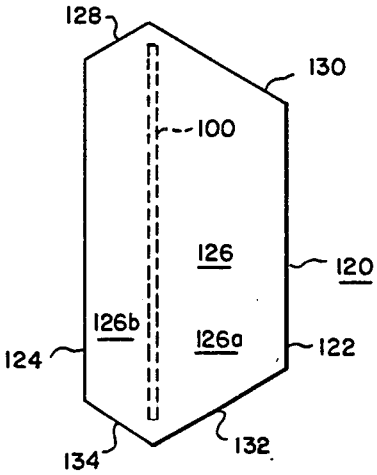
FIG. 4

30 μm

4 μm

20 μm

LOW METHIONINE GELATINO-PEPTIZER TABULAR GRAIN SILVER BROMIDE AND BROMOIODIDE EMULSIONS AND PROCESSES FOR THEIR PREPARATION

This is a continuation application of U.S. Ser. No. 811,133 filed Dec. 19, 1985 now abandoned.

FIELD OF THE INVENTION

The invention relates to processes for the precipitation of radiation-sensitive silver bromide and silver bromoiodide emulsions useful in photography.

BACKGROUND OF THE INVENTION

The highest speed and therefore most commonly employed photographic elements are those which contain a radiation-sensitive silver bromide or bromoiodide emulsion layer coated on a support. Although other ingredients can be present, the essential components of the emulsion layer are radiation-sensitive silver bromide microcrystals, optionally containing iodide, commonly referred to as grains, which form the discrete phase of the photographic emulsion, and a vehicle, which forms the continuous phase of the photographic emulsion.

It is important to recognize that the vehicle encompasses both the peptizer and the binder employed in the preparation of the emulsion layer. The peptizer is introduced during the precipitation of the grains to avoid their coalescence or flocculation. Peptizer concentrations of from 0.2 to 10 percent, by weight, based on the total weight of emulsion as prepared by precipitation, can be employed.

It is common practice to maintain the concentration of the peptizer in the emulsion as initially prepared below about 6 percent, based on total emulsion weight, and to adjust the emulsion vehicle concentration upwardly for optimum coating characteristics by delayed binder additions. For example, the emulsion as initially prepared commonly contains from about 5 to 50 grams of peptizer per mole of silver, more typically from about 10 to 30 grams of peptizer per mole of silver. Binder can be added prior to coating to bring the total vehicle concentration up to 1000 grams per mole of silver. The concentration of the vehicle in the emulsion layer is preferably above 50 grams per mole of silver. In a completed silver halide photographic element the vehicle preferably forms about 30 to 70 percent by weight of the emulsion layer. Thus, the major portion of the vehicle in the emulsion layer is typically not derived from the peptizer, but from the binder that is later introduced.

While a variety of hydrophilic colloids are known to be useful peptizers, preferred peptizers are gelatin—e.g., alkali-treated gelatin (cattle bone or hide gelatin) or acid-treated gelatin (pigskin gelatin)—and gelatin derivatives—e.g., acetylated gelatin or phthalated gelatin. Gelatin and gelatin derivative peptizers are hereinafter collectively referred to as "gelatino-peptizers".

Materials useful as peptizers, particularly gelatin and gelatin derivatives, are also commonly employed as binders in preparing an emulsion for coating. However, many materials are useful as vehicles, including materials referred to as vehicle extenders, such as latices and other hydrophobic materials, which are inefficient peptizers. A listing of known vehicles is provided by *Research Disclosure,* Vol. 176, Dec. 1978, Item 17643, Section IX, Vehicles and vehicle extenders. *Research Disclosure* is published by Kenneth Mason Publications, Ltd., Emsworth, Hampshire P010 7DD, England.

It has been recognized that when the gelatin incorporated in an emulsion layer of a photographic element is oxidized, modification of emulsion photographic properties can result. Corben et al U.S. Pat. No. 2,890,215 discloses the desensitization of gelatin by treatment with a peracid. Komatsu et al Japanese Kokai No. 58(1983)-70221 discloses improved keeping stability for internal latent image forming silver halide emulsions when oxidized gelatin is employed. Komatsu et al Japanese Kokai No. 59(1984)-195232 discloses improved storage stability for silver halide emulsions having silver chloride grain surfaces prepared using oxidized gelatin.

Moll, "Investigations of Oxidized Gelatins", 2nd Photographic Gelatin Symposium, sponsored by the Royal Photographic Society, Oxford, United Kingdom, Sept. 6, 1985, discloses that the chemical and physical properties of oxidized gelatins, including luminescence of emulsions prepared therefrom, do not differ substantially from those of the native gelatin. The sensitometry and growth restraining properties, however, are reportedly changed by the oxidation treatment. It is stated that these changes cannot be attributed to oxidation of methionine.

Mifune et al EPO No. 0,144,990 A2 discloses a process for controlled ripening of a silver halide emulsion with a sulfur containing silver halide solvent. An oxidizing agent is relied upon to terminate ripening of the emulsion once the desired extent of ripening is accomplished.

Interest in silver halide photography has recently focused on tabular grain emulsions, particularly thin intermediate and high aspect ratio tabular grain emulsions. It has been shown that these emulsions can produce a variety of photographic advantages, including increased sharpness, improved speed-granularity relationships, increased blue and minus blue speed separations, more rapid developability, higher silver covering power when fully forehardened, reduced crossover in spectrally sensitized Duplitized® (two sided) radiographic formats, and various imaging advantages in dye image transfer film units. *Research Disclosure,* Vol. 225, January 1983, Item 22534, is considered representative of these teachings.

Dickerson U.S. Pat. No. 4,520,098, issued May 28, 1985, commonly assigned, discloses that dye stain reduction can be achieved in photographic elements containing a spectrally sensitized tabular grain emulsion by choosing the halide forming the tabular grains from among chloride and bromide and employing fine high iodide grains in combination. Dickerson teaches the use of conventional vehicles, including oxidizing agent treated gelatin.

One of the inefficiencies that has been encountered in the preparation of tabular grain silver bromide and bromiodide emulsions is the presence of unwanted grain shapes. In addition to unwanted nontabular grains, also in evidence are thick tabular grains, which have aspect ratios closely approaching those of nontabular grains.

In addition to low aspect ratio tabular grains and nontabular grains, these tabular grain emulsions, particularly silver bromide tabular grain emulsions, also contain a significant population of grains which are in the form of rods. Because of their length and limited projected arcos rods are of marginal photographic utility. Beyond this, their presence in emulsions is disadvantageous in conventional procedures for manufacturing photographic elements containing silver halide emulsion layers.

It is also known that the introduction of iodide ions during the precipitation of tabular grain emulsions results in thickening of the tabular grains. Thus, when tabular grain silver bromide and silver bromiodide emulsions precipitated under similar conditions and having similar mean grain diameters are compared, the tabular grain silver bromide emulsions exhibit higher average aspect ratios.

Finally, the precipitation of thin tabular grain silver bromide and bromoiodide emulsions requires control of bromide ion concentrations within a narrow range during initial tabular grain formation. Nontabular and thick tabular grains result when bromide ion concentrations are not maintained during precipitation.

SUMMARY OF THE INVENTION

In one aspect this invention is directed to a process for the precipitation of a thin tabular grain emulsion comprising concurrently introducing into a reaction vessel silver, bromide, and, optionally, iodide ions to form tabular grains of less than 0.2 μm in thickness and maintaining the tabular grains in suspension with a gelatino-peptizer. The process for precipitation is characterized in that the gelatino-peptizer contains less than 30 micromoles of methionine per gram.

In another aspect this invention is directed to a thin tabular grain emulsion comprising tabular silver bromide or bromoiodide grains having a thickness of less than 0.2 μm and an aspect ratio of greater than 5:1 accounting for greater than 50 percent of the total grain projected area of said emulsion and a gelatino-peptizer containing less than 30 micromoles of methionine per gram.

It is an advantage of the present invention that thin tabular grain emulsions are produced having a lower proportion of grains of unwanted shapes. Thin tabular grain silver bromide emulsions can be prepared which contain a markedly reduced number of rods. Thin tabular grain silver bromoiodide emulsions can be prepared having thinner tabular grains than can be attained by otherwise comprable precipitation procedures failing to satisfy the requirements of this invention. Additionally, the present invention allows tabular grain silver bromide and bromoiodide emulsions to be precipitated over a wider range of bromide ion concentrations than has heretofore been possible in the art.

The present invention also makes possible thin, tabular grain emulsions exhibiting an increase in thin tabular grains of new shapes heretofore observed only as very exceptional grains. Specifically, by the practice of the present invention it is possible for the first time to prepare thin tabular grain emulsions containing a high proportion of thin trapezoidal tabular grains and thin irregular hexagonal tabular grains. In addition, the precipitation process of this invention is useful in producing unique thin triangular tabular grains.

BRIEF DESCRIPTION OF THE DRAWINGS

These and other advantageous features of the invention can be better appreciated by reference to the detailed description of the preferred embodiments considered in conjunction with the drawings, in which FIGS. 1 through 4 are drawings of grain shapes, greatly enlarged;

DESCRIPTION OF PREFERRED EMBODIMENTS

Figure 5:
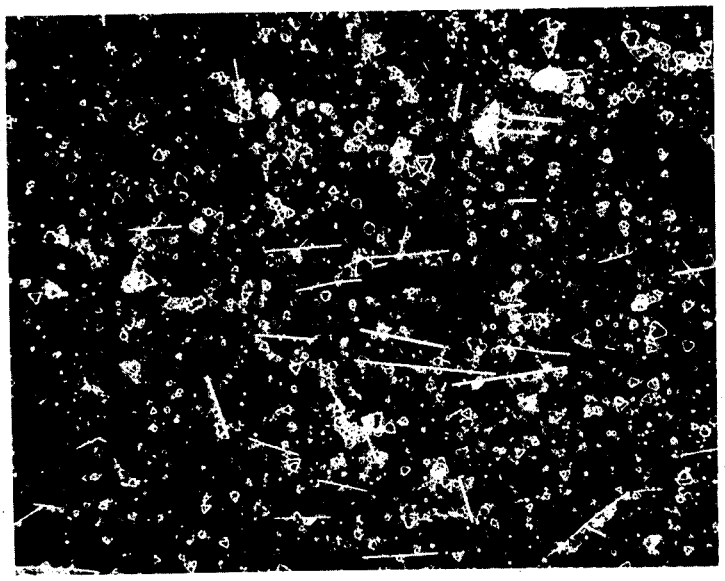
FIGS. 5 and 6 are electron micrographs of control and example emulsions, respectively.

It has been discovered quite unexpectedly that the advantages identified above can be realized by the modification of known precipitation procedures in which silver, bromide, and, optionally, iodide ions, are concurrently introduced into a reaction vessel to prepare a thin tabular grain emulsion. Specifically, it has been discovered that these advantages can be realized by employing a gelatino-peptizer containing a low level of methionine.

Gelation-peptizers are made up of or derived from proteins. While approximately twenty amino acids are known to make up proteins, methionine is the amino acid which is principally responsible for the divalent sulfur atoms in gelatino-peptizers. It is observed that organic compounds containing divalent sulfur atoms show a strong affinity for grain surfaces. Thus, methionine has a strong influence on the properties of gelatino-peptizers.

It is demonstrated in the examples below that gelatino-peptizers containing methionine in concentrations of less than 30 micromoles per gram exhibit observable advantages. To increase the advantages which can be realized by the practice of this invention the gelatino-peptizers employed preferably have a methionine concentration of less than 12 micromoles per gram and optimally have a methionine concentration of less than 5 micromoles per gram.

Gelatin is globally derived from animal protein—typically, animal hides and bones, and there are variations attributable to both geographic and animal sources as well as preparation techniques in the levels of methionine found in gelatin and its derivatives used as photographic peptizers. In rare instances gelatin as initially prepared is low in methionine and requires no special treatment to realize the less than 30 micromoles of methionine per gram criterion of this invention; but normally gelatin as initially prepared contains far in excess of the desired 30 micromoles of methionine per gram. These gelatino-peptizers can be modified to satisfy the low methionine requirements of this invention by treatment with an oxidizing agent. Further, even when employing gelatins which naturally contain low levels of methionine, methionine is still present in higher than optimum levels and can be improved for use in the practice of this invention by treatment with an oxidizing agent. While any of a variety of known strong oxidizing agents can be employed, hydrogen peroxide is a preferred oxidizing agent, since it contains only hydrogen and oxygen atoms. Appropriate levels of oxidizing agent are readily determined knowing the initial concentration of methionine in the gelatino-peptizer to be treated. An excess of oxidizing agent can be employed without adverse effect.

The oxidizing agent treatment of gelatino-peptizers eliminates or lowers the concentration of the methionine by oxidizing the divalent sulfur atom in the molecule. Thus, the divalent sulfur atoms are partially oxidized to tetravalent sulfinyl or fully oxidized to hexavalent sulfonyl groups.

It is believed that gelatino-peptizers containing less than 30 micromoles per gram of methionine are less tightly adsorbed to the peptized grain surfaces by reason of the reduced presence of divalent sulfur atoms in the peptizer. This observation does not, however, account for a variety of advantageous and unpredicted effects that have been observed in the preparation of thin tabular grain emulsions.

As previously noted, in the preparation of thin tabular grain emulsions, particularly silver bromide emulsions, a large number of rods, which are unwanted grain forms, are produced concurrently with the tabular grains. It has been observed that the rod population can be reduced to negligibly low levels by employing a low methionine gelatino-peptizer.

To gain a better understanding of the elimination of rods, samples of emulsions being precipitated according to the requirements of this invention have been taken at successive stages of growth. An observed mechanism for rod reduction in the emulsions of this invention can be appreciated by FIGS. 1 through 3. FIG. 1 is a schematic illustration of a rod 100 produced at an early stage of precipitation. The shape is accounted for by preferential precipitation at the ends 102 and 104 of the rod. It has been observed that the low methionine gelatino-peptizer allows a rod to begin preferential growth along one edge. Although not proven, the event that shifts preferential growth from the ends of the rod to an edge is believed to be elimination, probably by solvent action, of one of two nonparallel twin planes initially present in the rod. As preferential growth along one edge of the rod occurs, the rod is transformed as shown in Figure 2 into a thin tabular grain 106 having a trapezoidal projected area. The tabular grain has two parallel trapezoidal major faces, trapezoidal face 108 being visible in FIG. 2. The longer parallel edge 110 of the trapezoid corresponds in length to the rod 100, and a shorter parallel edge 112 is the edge at which precipitation preferentially occurs. Continued growth of the trapezoidal grain 106 remains preferential to the shorter of the parallel edges, thereby producing trapezoidal grain 114 shown in FIG. 3. It is to be noted in FIG. 3 that the still shorter parallel edge 116 has replaced the parallel edge 112 while the longer parallel edge 110 remains substantially unchanged. If growth of the trapezoidal tabular grain is allowed to continue, preferential growth at the shorter parallel edge 116 will transform the grain to one having a triangular projected area, as indicated by dashed lines 118. Once the grain exhibits an equilaterally triangular projected area, continued growth along each of the three triangle edges proceeds comparatively slowly and at the same rate.

It has been observed that the tabular trapezoidal and triangular grains produced as described above contain an odd number of twin planes parallel to the major faces of the grains. It is believed that a single twin plane is located in these tabular grains parallel to their major faces.

An alternate growth path from rod 100 to a tabular grain structure is illustrated in FIG. 4. Tabular grain 120 is shown with the location of the rod 100 which serves as the nucleus for tabular grain growth indicated by dashed lines. In this growth pattern tabular growth results from concurrent growth in two opposite directions from the edges of the original rod. Growth is preferential to the edges 122 and 124, which are parallel to the original rod. It has been observed in tabular grains of this shape that an even number of twin planes separate the major faces of the tabular grain, and it is believed that these grains each contain two parallel twin planes parallel to the two major faces of the grain. In FIG. 4 major face 126 is shown. In addition to preferential growth along edges 122 and 124 observable growth also occurs at the edges 128, 130, 132, and 134.

As shown in FIG. 4, the major face 126 of the tabular grain 120 presents a hexagonal projected area. The hexagonal projected area can be viewed as two trapezoidal projected area components **126*a* and 126*b* joined along a common base corresponding to the location of the original rod. As shown in FIG. 4** the two trapezoidal projected area components are unequal, but emulsions have been investigated in which these trapezoidal projected area components are equal in area.

Still other tabular trapezoidal grains have been observed to grow by differing, not entirely understood mechanisms.

In preparing thin tabular grain emulsions employing gelatino-peptizers with conventional levels of methionine trapezoidal grains are highly atypical of the overall grain population observed. When thin tabular grain emulsions are prepared with low methionine gelatino-peptizers according to this invention, the proportion of trapezoidal grains is increased. It is not uncommon for thin tabular grains of trapezoidal projected area, such as illustrated in FIGS. 2 and 3, hereinafter referred to as thin trapezoidal grains, to account for greater than 2 percent of the total grain population. Further, though present in a lower proportion, hexagonal grains of the type illustrated by FIG. 4 are also increased, as well as grain shapes discussed above derivative from these thin trapezoidal tabular grains. By forming thin tabular grains according to the invention under conditions that permit slow growth and a high degree of ripening, emulsions have been prepared according to the invention in which thin trapezoidal grains account for more than 50 percent of the total grain projected area of the emulsions. Such emulsions have been produced by employing low silver and bromide ion introduction rates—i.e., extended run times—or by stopping the run and holding the emulsion under conditions that permit spontaneous ripening. The increasing proportion of thin trapezoidal grains under these preparation conditions suggests that once formed these grains grow at a more rapid rate than other grains, allowing the other grains to be partially or entirely removed by ripening.

In preparing thin tabular grain emulsions in which the precipitated halide consists essentially of bromide, marked increases in tabular grain average aspect ratios are observed for precipitations employing low methionine gelatino-peptizers as compared to gelatino-peptizers with higher methionine levels. For comparable run times the low methionine gelatino-peptizers produce larger mean diameter thin tabular grain emulsions and have been observed to produce thinner tabular grains. When significant levels of iodide ions are also present during precipatation, thinner tabular grains are realized using low methionine gelatino-peptizers as compared to gelatino-peptizers with higher methionine levels.

In precipitating thin tabular grain silver bromide and bromoidide emulsions, it is recognized that the bromide ion concentration in solution at the stage of grain formation must be maintained within limits to achieve the desired tabularity of the grains. As grain growth continues the bromide ion concentration in solution becomes progressively less influential on the grain shape ultimately achieved. For example, Wilgus et al U.S. Pat.

No. 4,434,226 teaches the precipitation of high aspect ratio tabular grain silver bromoidide emulsions at bromide ion concentrations in the pBr range of from 0.6, preferably 1.1, to 1.6 during grain nucleation with the pBr range being expanded to 0.6 to 2.2 during subsequent grain growth. Kofron et al U.S. Pat. No. 4,439,520 extends these teachings to the precipitation of high aspect ratio tabular grain silver bromide emulsions. Since silver iodide exhibits a solubility product constant approximately two orders of magnitude lower than that of silver bromide, the low incidence of iodide ions in solution during precipitation does not significantly alter useful pBr ranges. pBr is defined as the negative log of the solution bromide ion concentration.

While the pBr ranges above are useful in the practice of this invention, it has been discovered quite unexpectedly that by employing a low methionine gelatino-peptizer during precipitation of thin tabular grain silver bromide or bromoidide emulsions lower bromide ion concentrations can be present during initial grain formation—i.e., nucleation. Thin tabular grain emulsions satisfying the requirements of this invention can be prepared by precipitating during grain nucleation and/or growth at pBr levels of up to 2.4. Although nontabular grains produced concurrently with the thin tabular grains produced concurrently with the thin tabular grains desired can be separated and discarded to increase the proportion of tabular grains in the product emulsion, it is preferred to employ pBr values of 2.2 or less and optimally to employ pBr values of 2.0 or less at the start of precipitation. When nucleating at pBr levels above 1.6 using gelatino-peptizers with higher methionine levels, emulsions in which the grains consist entirely of regular (i.e., nontabular) octahedra have been observed. Thus, this invention makes possible for the first time thin tabular grain nucleation in the pBr range of from 1.6 to 2.4.

The thin tabular grain emulsions of this invention can be prepared by incorporating one or more of the features discussed above in any conventional process for preparing thin tabular grain emulsions. For example, it is specifically contemplated to prepare thin tabular grain emulsions according to this invention by modifying in the manner described above the teachings of Wilgus et al U.S. Pat. No. 4,434,226; Kofron et al U.S. Pat. No. 4,439,520; Daubendiek et al U.S. Pat. No. 4,414,310; Abbott et al U.S. Pat. No. 4,425,425 and 4,425,426; Solberg et al U.S. Pat. No. 4,433,048; Dickerson U.S. Pat. No. 4,414,304; Jones et al U.S. Pat. No. 4,478,929; Maskasky U.S. Pat. No. 4,435,501; and Research Disclosure, Vol. 225, January 1983, Item 22534, and Vol. 232, August 1983, Item 23206; each of which are incorporated by reference.

Subject to methionine level requirements set forth above, the preferred gelatino-peptizer for use in the practice of this invention is gelatin. Of the various modified forms of gelatin, acetylated gelatin and phthalated gelatin constitute preferred gelatin derivatives. Specific useful forms of gelatin and gelatin derivatives can be chosen from among those disclosed by Yutzy et al U.S. Pat. Nos. 2,614,928 and 2,614,929; Lowe et al U.S. Pat. Nos. 2,614,930 and 2,614,931; Gates U.S. Pat. Nos. 2,787,545 and 2,956,880; Ryan U.S. Pat. No. 3,186,846; Dersch et al U.S. Pat. No. 3,436,220; and Luciani et al U.K. Pat. No. 1,186,790.

Precipitations according to the invention concurrently introduce into a reaction vessel silver, bromide, and, optionally, iodide ions to precipitate the desired thin tabular grain silver bromide or bromoiodide emulsion. The reaction vessel initially contains water as a dispersing medium. A relatively small amount of bromide ion is introduced into the reaction vessel to produce the desired initial pBr. Since very small grains can be held in suspension without a peptizer, peptizer can be added after grain formation has been initiated, but in most instances it is preferred to add at least 10 percent and, most preferably at least 20 percent, of the peptizer present at the conclusion of precipitation to the reaction vessel before grain formation occurs. The low methionine gelatino-peptizer is preferably the first peptizer to come into contact with the silver halide grains. Gelatino-peptizers with conventional methionine levels can contact the grains prior to the low methionine gelatino-peptizer, provided they are maintained below concentration levels sufficient to peptize the tabular grains produced. For instance, any gelatino-peptizer with a conventional methionine level of greater than 30 micromoles per gram initially present is preferably held to a concentration of less than 1 percent of the total peptizer employed. While it should be possible to use any conventional peptizer toward the end of precipitation with minimal adverse impact on the emulsions, it is preferred that the low methionine gelatino-peptizer be used as the sole peptizer throughout the formation and growth of the thin tabular grain emulsion.

Silver, bromide, and, optionally, iodide ions are concurrently run into the reaction vessel. The silver ions are preferably supplied in an aqueous solution of silver nitrate. The bromide and iodide ions are preferably supplied, separately or together, in aqueous solutions of ammonium or alkali metal salts. Mignot U.S. Pat. No. 4,334,012, which is concerned with ultrafiltration during emulsion precipitation and here incorporated by reference, sets forth a variety of preferred procedures for managing the introduction of gelatino-peptizer, silver, bromide, and iodide ions during emulsion precipitation. Introduction of silver and halide ions in the form of a Lippmann emulsion, as taught by Mignot, is specifically contemplated.

Modifying compounds can be present during emulsion precipitation. Such compounds can be initially in the reaction vessel or can be added along with one or more of the peptizer and ions identified above. Modifying compounds, such as compounds of copper, thallium, lead, bismuth, cadmium, zinc, middle chalcogens (i.e., sulfur, selenium, and tellurium), gold, and Group VIII noble metals, can be present during precipitation, as illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; Sidebotham U.S. Pat. No. 3,488,709; Rosecrants et al U.S. Pat. No. 3,737,313; Berry et al U.S. Pat. No. 3,772,031; Atwell U.S. Pat. No. 4,269,927; *and Research Disclosure,* Vol. 134, June 1975, Item 13452. It is also possible to introduce one or more spectral sensitizing dyes into the reaction vessel during precipitation, as illustrated by Locker et al U.S. Pat. No. 4,225,666.

The emulsion which is produced by the above described preparation procedure is a thin tabular grain emulsion comprised of the low methionine gelatino-peptizer and tabular silver bromide or bromoiodide grains having a thickness of less than 0.2 μm and an aspect ratio of greater than 5:1 accounting for greater than 50 percent of the total grain projected area of the emulsion.

The aspect ratio of the grains is determined by dividing the grain thickness by the grain diameter. Grain diameter is its equivalent circular diameter—that is, the diameter of a circle having an area equal to the projected area of the grain. Grain dimensions can be determined from known techniques of microscopy.

The preferred emulsions prepared according to the present invention are those in which the tabular grains of a thickness less than 0.2 μm and an aspect ratio of at least 5:1 have an average aspect ratio of greater than 8:1, most preferably at least 12:1, and optimally at least 20:1. The preferred emulsions are those in which the tabular grains of a thickness less than 0.2 μm and an aspect of at least 5:1 account for greater than 70 percent and, optimally, greater than 90 percent of the total grain projected area. While the thin tabular grain projected area criteria can be met by the precipitation procedures set forth above, known grain separation techniques, such as differential settling and decantation, centrifuging, and hydrocyclone separation, can, if desired, be employed. An illustrative teaching of hydrocyclone separation is provided by Audran et al U.S. Pat. No. 3,326,641.

The thin tabular grain emulsions can be put to photographic use as precipitated, but are in most instances adapted to serve specific photographic applications by procedures well known in the art. It is important to note that once an emulsion has been prepared as described above any conventional vehicle, including gelatin and gelatin derivatives of higher methionine levels, can be introduced while still realizing all of the advantages of the invention described above. Also the emulsions can be blended with other silver halide emulsions, as illustrated by *Research Disclosure,* Item 17643, cited above, Section I, Paragraph F, and Dickerson U.S. Pat. No. 4,520,098, cited above. Other useful vehicle materials are illustrated by *Research Disclosure,* Item 17643, Section IX, cited above. Conventional hardeners can be used, as illustrated by Item 17643, Section X. The emulsions can be washed following precipitation, as illustrated by Item 17643, Section II. The emulsions can be chemically and spectrally sensitized as described by Item 17643, Sections III and IV; however, the emulsions are preferably chemically and spectrally sensitized as taught by Kofron et al U.S. Pat. No. 4,439,520, cited above. The emulsions can contain antifoggants and stabilizers, as illustrated by Item 17643, Section VI.

The emulsions of this invention can be used in otherwise conventional photographic elements to serve varied applications, including black-and-white and color photography, either as camera or print materials; image transfer photography; photothermography; and radiography. The remaining sections of *Research Disclosure,* Item 17643, illustrate features particularly adapting the photographic elements to such varied applications.

EXAMPLES

The invention can be better appreciated by reference to the following specific examples. Except as otherwise noted the gelatin employed as a starting material prior to hydrogen peroxide treatment, if any, contained approximately 55 micromoles of methionine per gram.

EXAMPLE 1

This example illustrates an increase in aspect ratio and a major reduction in the frequency of rods during the preparation of a thin tabular grain silver bromide emulsion using a low methionine gelatin peptizer according to the invention.

EMULSION 1A

A Control Emulsion

The precipitation vessel was charged with 400 g of an aqueous solution containing 6.0 g deionized bone gelatin. The pBr was adjusted with KBr to a value of 1.25 at 80° C., maintained throughout the precipitation. With stirring, 2M $AgNO_3$ and 2M KBr were added over a period of 0.5 min. at a rate consuming 0.83% of the total silver used in the precipitation. Addition was continued over a period of 46 min. using linearly accelerating flow (11× from start to finish) and consuming the remaining 99.17% of the total silver used in the precipitation. A total of 0.30 moles of silver bromide was precipitated. The emulsion had a mean grain diameter of 2.5 μm and a mean grain thickness of 0.120 μm, with thin tabular grains representing more than 90 percent of the total grain projected area. A photomicrograph of the resulting emulsion is shown in FIG. 5.

EMULSION 1B

An Example Emulsion

This emulsion was prepared identically to Emulsion 1A, except that the gelatin used in the precipitation was pretreated as follows: To 500 g of 12.0% deionized bone gelatin was added 0.6 g of 30% $H_2O_2$ in 10 ml of distilled water. The mixture was stirred for 16 hours at 40° C., then cooled and stored for use.

Figure 6:
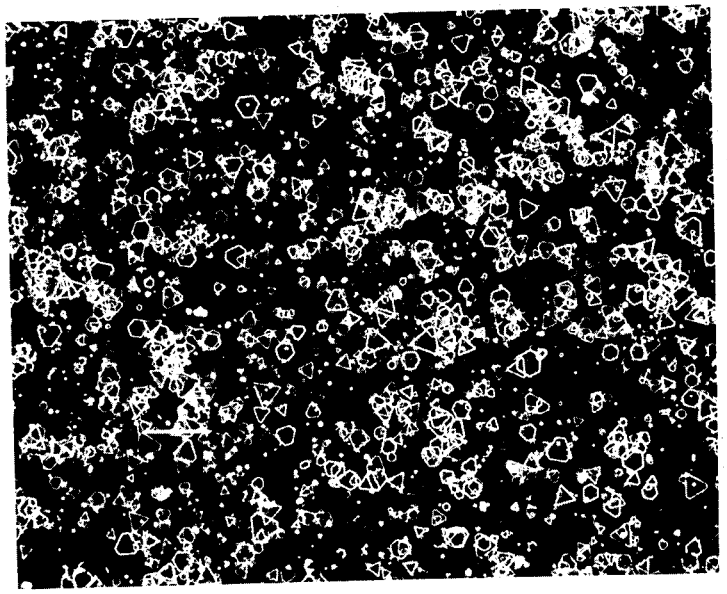

The emulsion had a mean grain diameter of 5.2 μm and a mean thickness of 0.094 μm, with thin tabular grains representing more than 90 percent of the total grain projected area. The emulsion therefore satisfied the optimum projected area and aspect ratio requirements of the invention. A photomicrograph of the resulting emulsion is shown in FIG. 6.

Results

FIG. 5 reveals numerous rod shaped crystals in the control emulsion prepared in deionized bone gelatin. As illustrated by FIG. 6 the rod population was reduced by more than a factor of 10 in the emulsion of the invention precipitated using a peptizer gelatin pretreated with an oxidizing agent. It is also to be noted that the mean grain diameter was 5.2 μm in the example emulsion as compared to 2.5 μm in the control emulsion and that the average aspect ratio of the example emulsion was 55:1 as compared to 21:1 for the control emulsion.

EXAMPLE 2

To obtain a quantitative comparison of the rod content of Emulsions 1A and 1B, unfiltered samples of the two emulsions were coated at 170 mg Ag/m$^2$ and 540 mg gelatin/m$^2$. From dark field illuminated photomicrographs, the number of rods for a given film area was counted for the two emulsions. The data is tabulated below in Table I.

TABLE I

| Emuls'n | Ag Analysis | Film Area Examined | Rods Counted | Rods/Ag mole ($\times 10^{-10}$) |
|---|---|---|---|---|
| 1A | 174 mg/m$^2$ | 1.37 mm$^2$ | 279 | 12.7 |
| 1B | 171 mg/m$^2$ | 2.78 mm$^2$ | 18 | 1.1 |

As can be seen, Control Emulsion 1A has more than 10 times the number of rods found in Example Emulsion 1B.

EXAMPLE 3

This example illustrates a major reduction of the frequency of rods during the precipitation of a thin tabular grain silver bromide emulsion using a low methionine gelatin peptizer according to the invention. Grain growth time was shortened during precipitation of the emulsion of the invention to provide a mean grain size approximating that of the control emulsion, thereby permitting a comparison of filterability.

EMULSION 3A

A Control Emulsion

The precipitation vessel was charged with 4.34 L of water containing 67.5 g of deionized bone gelatin and 76.5 g KBr. The temperature was adjusted to 55° C. and maintained throughout the precipitation. The pBr was measured as 1.0 at 55° C. With stirring 0.1M $AgNO_3$ and 0.39M KBr were added over a period of 8 min. while maintaining a pBr of 1.0, at a constant rate consuming 2.0% of the total silver used in the precipitation. The pBr was then adjusted to 1.4 by the addition of 2.0M $AgNO_3$ over a period of 6.8 min. consuming 6.8% of the total silver used. Precipitation was continued by the addition of 2.0M $AgNO_3$ and 2.29M KBr over a period of 32.5 min. at a linearly accelerating rate (6.1× from start to finish) while maintaining the pBr at 1.4, and consuming 57.9% of the total silver used. The pBr was then adjusted to 2.7 by the addition of 2.0M $AgNO_3$ over a period of 4.5 min., consuming 5.7% of the total silver used. Addition of the 2.0M $AgNO_3$ and 2.29M KBr was then continued at a constant rate over a period of 27.5 min., consuming 27.7% of the total silver used, and maintaining the pBr at 2.7. The emulsion was then washed by the procedure of Yutzy and Russell, U.S. Pat. No. 2,614,929, made up to a total of 40 g/Ag mole of gelatin, and stored. A total of 8.0 moles of silver was used in the precipitation.

From electron micrographs it was determined that the emulsion was a thin tabular grain emulsion well within the tabular grain thickness, aspect ratio, and projected area requirements previously identified for such emulsions. The mean grain diameter was 1.8 μm, and the mean grain thickness was about 0.1 μm.

EMULSION 3B

AN EXAMPLE EMULSION

The precipitation vessel was charged with 4.34 L of water containing 67.5 g of deionized bone gelatin treated with $H_2O_2$ (as described in Example 1B) and 76.5 g KBr. The temperature was adjusted to 55° C. and maintained throughout the precipitation. The pBr was measured as 1.0 at 55° C. With stirring, 0.1M $AgNO_3$ and 0.39M KBr were added over a period of 8 min., while maintaining a pBr of 1.0, at a constant rate consuming 2.5% of the total silver used in the precipitation. The pBr was then adjusted to 1.4 by the addition of 2.0M $AgNO_3$ over a period of 6.7 min., consuming 8.3% of the total silver used. Precipitation was continued by the addition of 2.0M $AgNO_3$ and 2.29M KBr over a period of 25 min., at a linearly accelerating rate (4.9× from start to finish), while maintaining a pBr of 1.4, and consuming 45.4% of the total silver used. The pBr was then adjusted to 2.7 by the addition of 2.0M $AgNO_3$ over a period of 6.5 min., consuming 10% of the total silver used. Addition of the 2.0M $AgNO_3$ and 2.29M KBr was then continued at a constant rate over a period of 27.5 min., consuming 33.8% of the total silver used, and maintaining the pBr at 2.7. The emulsion was then washed and stored similarly as Emulsion 3A. A total of 6.5 moles of silver was used in the precipitation.

From electron micrographs it was determined that the emulsion was a thin tabular grain emulsion well within the tabular grain thickness, aspect ratio, and projected area requirements previously identified for such emulsions. The mean grain diameter was 2.1 μm, and the thickness about 0.1 μm.

FILTERABILITY DETERMINATION

Emulsions 3A and 3B, made up to 40 g/Ag mole gelatin and 1.5 kg/Ag mole total weight, were subjected to a filtration rate test. An emulsion sample at 40° C. was drawn into a filter of 1.77 $cm^2$ cross-sectional area, by means of the suction of a water aspirator. The amount of emulsion which had passed through the filter by the time clogging occurred, as indicated by bubbling of the filtrate under the applied vacuum, was determined. The filter medium was fiberglass, providing approximately 90–95% removal of 6 μm particles, and approximately 100% removal of 12 μm particles. The results are tabulated in Table II.

TABLE II

| Emulsion | Filterability moles/$cm^2$ |
|---|---|
| 3A, Control | 0.0021 |
| 3B, Invention | 0.032 |

The filterability was improved by more than an order of magnitude by the use of the low methionine gelatin peptizer according to the invention.

EXAMPLE 4

Figure 7:
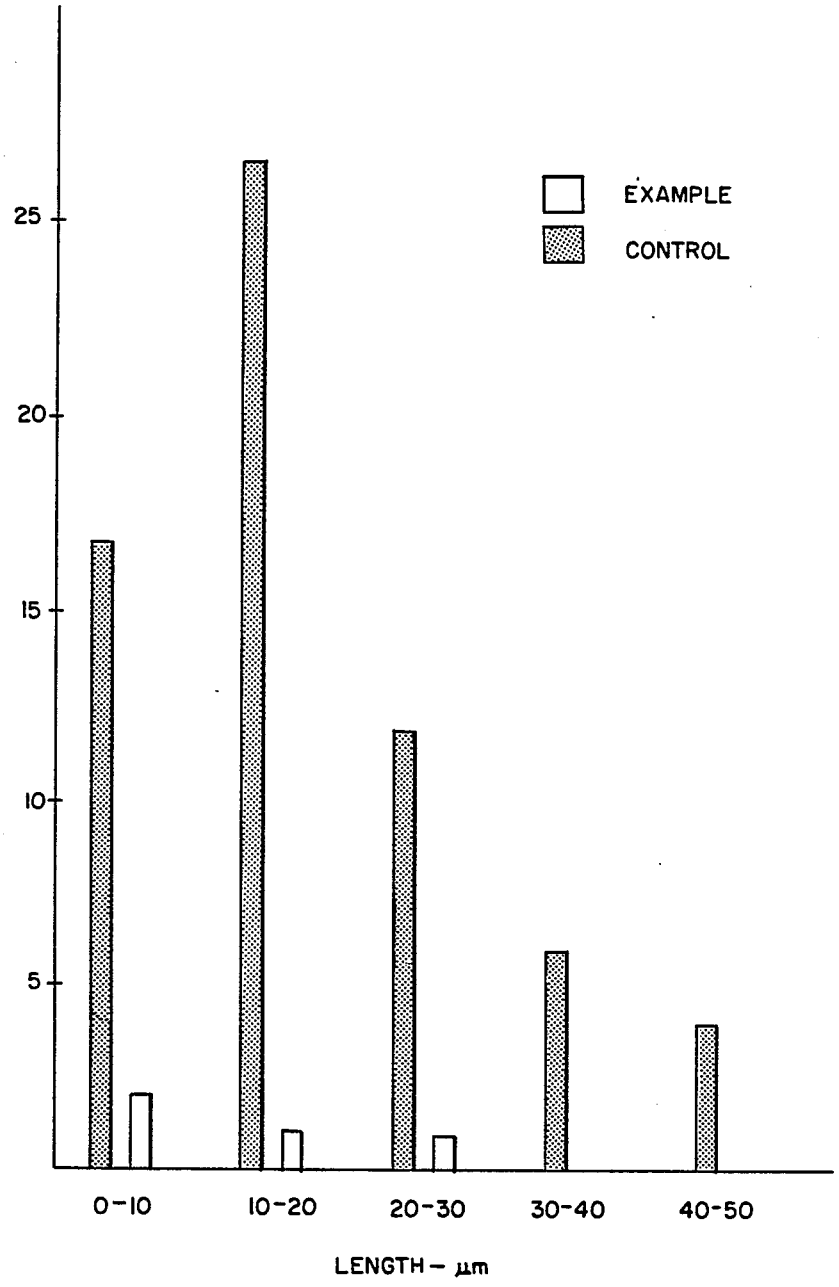
FIG. 7 is a plot of numbers of rods in various length groups.

To compare the frequency of rod occurrences as a function of rod length thin coatings were made of each of Emulsions 3A and 3B at approximately 160 mg/$m^2$ Ag and 540 mg/$m^2$ gelatin on a clear film support. For each emulsion coating, four 1000× photomicrograph fields, totalling an area of 40,000 $\mu m^2$ were visually evaluated for number and length of rods. The results are plotted in FIG. 7, which shows number of rods for each length classification. The size and number of rods were dramatically reduced in Emulsion 3B satisfying the requirements of the invention.

EXAMPLE 5

Emulsions 3A and 3B were chemically sensitized with sulfur, selenium, and gold and spectrally sensitized with anhydro-5,5'-dichloro-9-ethyl-3,3'-di(3-sulfopropyl)oxacarbocyanine hydroxide, sodium salt, 400 mg/Ag mole. The emulsions were coated on a cellulose acetate support at 2.15 g/$m^2$ and 3.96 g/$m^2$ gelatin. The stabilizer 4-hydroxy-6-methyl-1,3,3a,7-tetraazaindene, sodium salt, was added at 2.10 g/Ag mole, and the coatings were hardened with bis(vinylsulfonylmethyl) ether at 0.5% of the gelatin level.

Samples of the coatings were exposed for 0.1 sec. to a 365 nm Hg line source through a graduated density tablet and developed for 5 min. at 20° C. in Kodak Rapid X-ray Developer. Sensitometric results are tabulated in Table III.

TABLE III

| Emulsion | Relative Speed | Gamma | Fog |
|---|---|---|---|
| 3A, Control | 100 | 1.73 | .09 |

TABLE III-continued

| Emulsion | Relative Speed | Gamma | Fog |
|---|---|---|---|
| 2B, Invention | 89 | 1.96 | .06 |

Use of the low methionine gelatin in the preparation of Emulsion 2B was found to be compatible with useful emulsion sensitometric characteristics.

EXAMPLE 6

This example correlates the level of methionine in the thin tabular grain emulsions prepared with the rod content of the emulsions.

A series of emulsions were prepared by the precipitation procedure described for Emulsion 1A. After precipitation, each emulsion was washed by the procedure of Yutzy and Russell, U.S. Pat. No. 2,614,929, made up to a total of about 40 g/Ag mole gelatin, and stored. Gelatin containing 56 micromoles of methionine per gram was employed as a starting material. However, after the initial emulsion was prepared using this gelatin for precipitation, subsequent emulsions were prepared by first treating the gelatin with progressively larger amounts of hydrogen peroxide. The treated gelatin was analyzed for methionine content in each instance. The emulsion produced, the hydrogen peroxide used in gelatin treatment, and the methionine content found by analysis are reported in Table IV.

TABLE IV

| Emulsion | $H_2O_2$ Added (μmole/g gelatin) | Methionine (μmole/g gelatin) |
|---|---|---|
| 6A, Control | 0 | 56 |
| 6B, Control | 9 | 48 |
| 6C, Control | 18 | 33 |
| 6D, Example | 35 | 12 |
| 6E, Example | 53 | <4 |
| 6F, Example | 70 | <4 |
| 6G, Example | 91 | <4 |

The emulsions were identically coated at approximately the same silver coverages. Using the coatings the number of rods was counted in a 0.96 $mm^2$ area with the aid of dark field optical microscopy. To eliminate minor differences in the silver coverage of each emulsion as coated, the number of rods per $10^{-10}$ silver mole was calculated for each emulsion. Silver coverages, rods counted, and rods per $10^{-10}$ silver mole are shown in Table V.

TABLE V

| Emulsion | Silver Coverage ($mg/m^2$) | Rods Counted | Rods/$10^{-10}$ Ag mole |
|---|---|---|---|
| 6A, Control | 191.6 | 601 | 35.2 |
| 6B, Control | 193.8 | 323 | 18.7 |
| 6C, Control | 177.6 | 206 | 13.0 |
| 6D, Example | 178.7 | 30 | 1.89 |
| 6E, Example | 138.9 | 15 | 1.21 |
| 6F, Example | 173.3 | 23 | 1.49 |
| 6G, Example | 172.2 | 18 | 1.17 |

From Tables IV and V it is apparent that a reduction in rods is experienced at methionine levels of less than 30 micromoles per gram of gelatin and that a very marked reduction in rods occurs at methionine levels of less than 12 micromoles of methionine per gram of gelatin. Optimally, methionine is reduced to less than 5 micromoles per gram of gelatin.

EXAMPLE 7

A sample of commercially available first run India cattle bone gelatin having an exceptionally low (15 to 17 micromole per gram of gelatin) methionine content was employed without any preliminary hydrogen peroxide treatment to prepare Emulsion 7A by the procedures described in Example 6. Silver coverage, rods counted, and rods per $10^{-10}$ silver mole are shown in Table VI.

TABLE VI

| Emulsion | Silver Coverage ($mg/m^2$) | Rods Counted | Rods/$10^{-10}$ Ag mole |
|---|---|---|---|
| 7A, Example | 184.1 | 147 | 8.97 |

While rod reduction were observed as compared to the control emulsions in Example 6, the emulsion exhibited a higher rod population than the preferred example emulsions of Example 6 containing methionine levels of less than 12 micromoles per gram of gelatin.

EXAMPLE 8

The emulsions of this example illustrate the effect of oxidized gelatin used during the precipitation on the dimensions of silver bromoiodide (1 mole percent iodide) tabular grains. Initial pH adjustments were made with NaOH or $HNO_3$ as required.

EMULSION 8A:

A CONTROL EMULSION

The reaction vessel was charged with a total volume of 2 L, containing 30.0 g of deionized bone gelatin and KBr to provide a pBr of 1.14, maintained throughout the precipitation. The temperature was adjusted to 55° C. and the pH to 5.6 at 55° C. With stirring, 1.0M $AgNO_3$and 1.14M KBr were added over a period of 1.0 min at a constant rate consuming 0.42% of the total silver used in the precipitation. Addition was then continued over a period of 83 min at a linearly accelerating rate (4.2× from start to finish) consuming the remaining 99.58% of the total silver used in the precipitation. The KBr solution was added throughout as required to maintain the pBr at 1.14. After one minute into the precipitation a 0.01M KI solution was added simultaneously at the same rate as the $AgNO_3$ solution. A total of 1.20 moles Ag was consumed in the precipitation. The emulsion was washed and made up with gelatin as described for Example 6.

The resulting tabular silver bromoiodide emulsion grains (1.0 mole % iodide) had a mean diameter of 3.7 μm, a mean thickness of 0.079 μm, an average aspect ratio of 47:1, and more than 85% of the total projected area of the emulsion grains consisted of tabular grains of thickness 0.2 μm or less and aspect ratio 5:1 or more.

EMULSION 8B

AN EXAMPLE EMULSION

This emulsion was prepared similarly as Emulsion 8A, except that the gelatin used in the precipitation was pretreated with hydrogen peroxide similarly as that employed in preparing Emulsion 1B. The resulting tabular silver bromoiodide emulsion grains (1.0 mole % iodide) had a mean diameter of 2.6 μm, a mean thickness of 0.071 μm, an average aspect ratio of 37:1, and similar projected area characteristics as the control Emulsion 8A.

As in the case of the tabular grain silver bromide emulsion examples, the use of the low methionine gelatin according to the invention provided a tabular silver bromoiodide emulsion of reduced thickness.

EXAMPLE 9

The emulsions of this example illustrate the effect of low methionine gelatin used during the precipitation on the final dimensions of a tabular grain silver bromoiodide (3 mole % iodide) emulsion.

EMULSION 9A

A Control Emulsion

This emulsion was prepared similarly as Emulsion 8A, except using a 0.06M KI solution, 2M/L $AgNO_3$ solution, and 4.3M/L KBr solution to provide a final AgI content of 3 mole %. A total of 2.4 moles Ag was consumed.

The resulting tabular silver bromoiodide emulsion grains had a mean diameter of 4.9 μm, a mean thickness of 0.11 μm, and an average aspect ratio of 45:1, and more than 85% of the total projected area of the emulsion consisted of tabular grains of thickness 0.2 μm or less, and aspect ratio 5:1 or more.

EMULSION 9B

An Example Emulsion

This emulsion was precipitated similarly as Emulsion 9A, but using gelatin oxidized similarly as that of Emulsion 1B.

The resulting tabular silver bromoiodide (3 mole % iodide) grains had a mean diameter of 3.2 μm, mean thickness of 0.086 μm, and an average aspect ratio of 37:1, and the emulsion had similar projected area characteristics to that of Emulsion 9A. At this iodide level the use of oxidized gelatin resulted in a marked reduction in grain thickness.

EXAMPLE 10

The emulsions of this example illustrate the ability provided by the use of low methionine gelatin to prepare high aspect ratio tabular grain silver bromide emulsions at lower ambient bromide concentrations than can be used when the gelatin employed contains the common, higher methionine concentrations. For this example a pBr of 1.78 is used throughout the precipitation.

EXAMPLE 10A

A Control Emulsion

Figure 8:
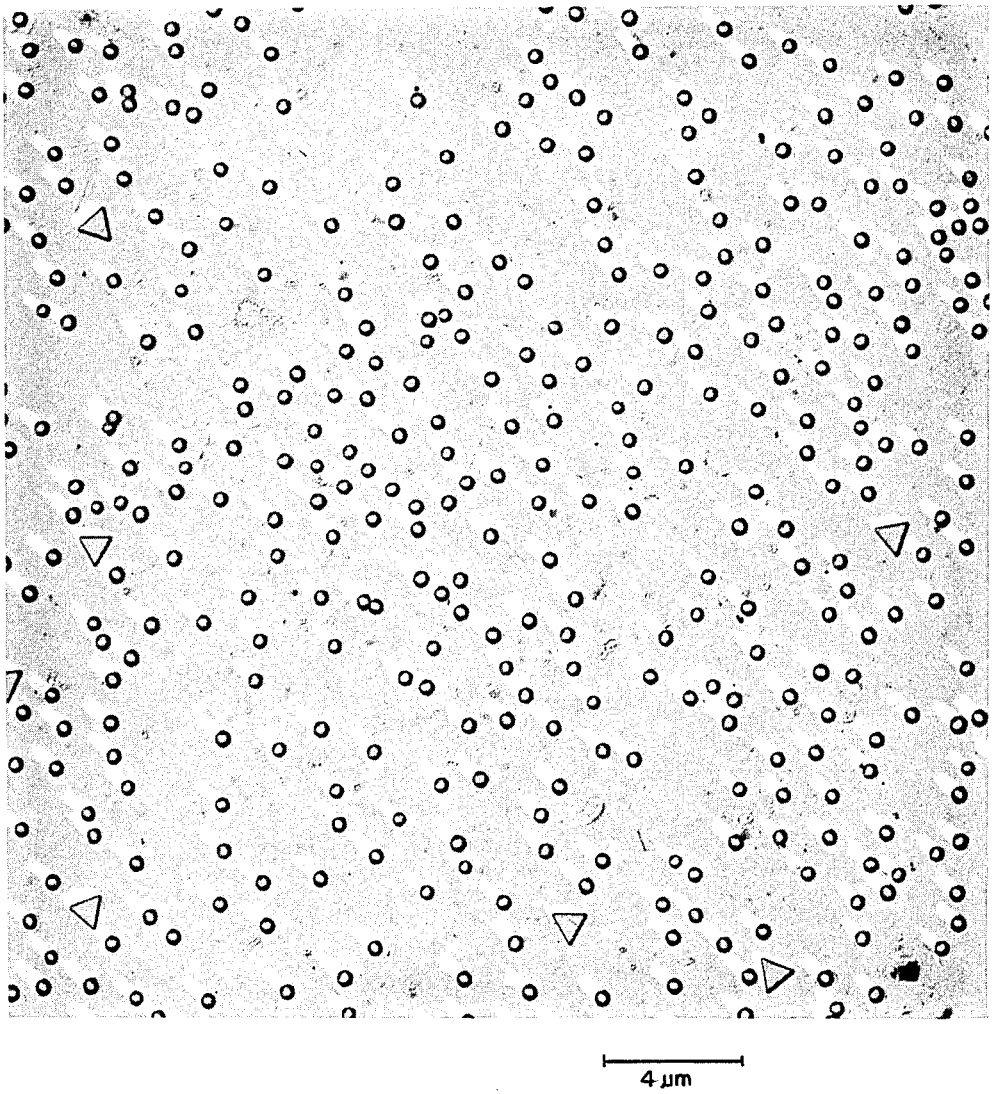
FIG. 8 is an electron micrograph of a control emulsion.

The reaction vessel was charged with a total volume of 2 L, containing 30.0 g of deionized bone gelatin and KBr to provide a pBr of 1.78, maintained at this value throughout the precipitation. The pH was adjusted to 5.6 at 40° C. The temperature was then raised to 75° C. With stirring 1.0M $AgNO_3$ and 1.0M KBr were added over a period of 1.0 min. at a constant rate consuming 0.5% of the total silver used in the precipitation. Addition was then continued over a period of 76 min at a linearly accelerating rate (3.9× from start to finish) consuming the remaining 99.5% of the total silver used in the precipitation. The KBr solution was added throughout as required to maintain the pBr at 1.78. A total of 1.0 moles Ag was consumed in the precipitation. The emulsion was washed and made up with gelatin as described for Example 4. The resulting emulsion grains were regular octahedra, of mean grain size 0.35 μm. A 6000× carbon replica electron micrograph is shown in FIG. 8.

EMULSION 10B

An Example Emulsion

This emulsion was precipitated similarly as Emulsion 10A, but using gelatin oxidized similarly as that of Emulsion 1B.

Figure 9:
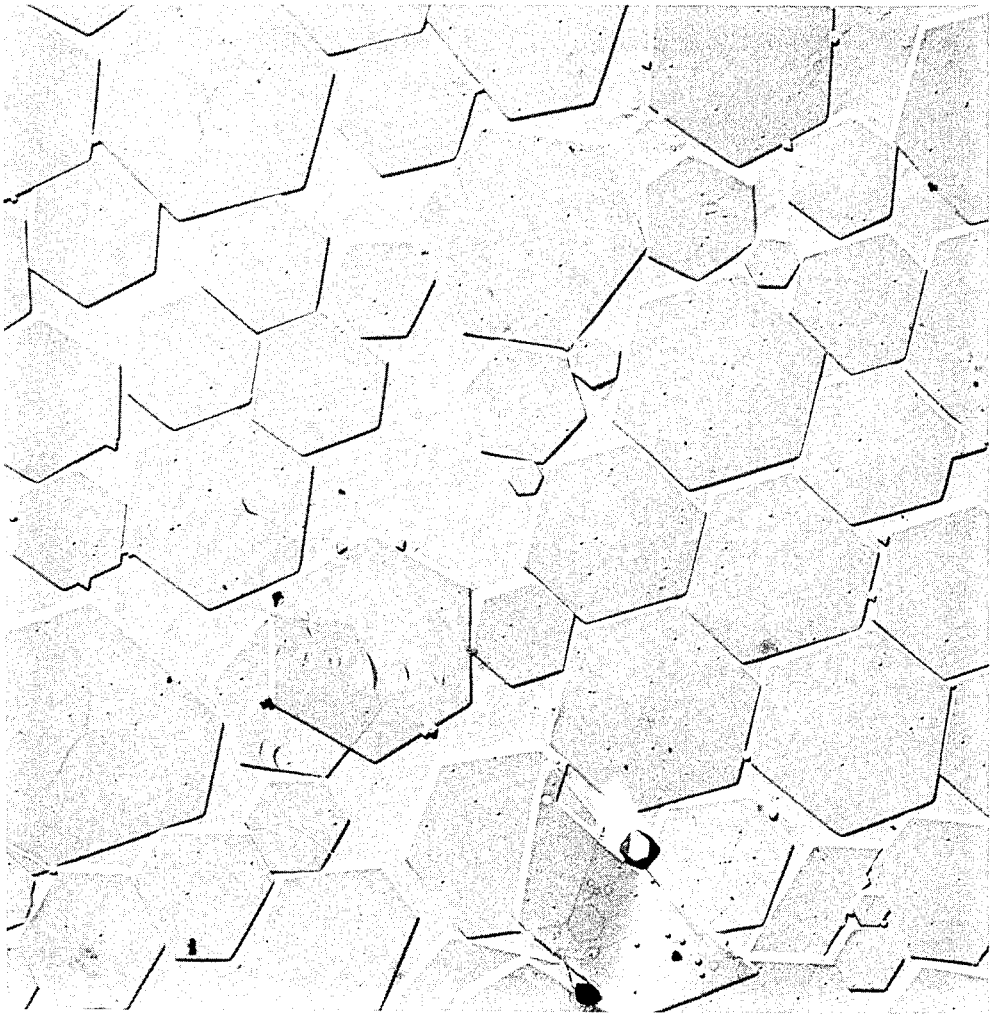
FIGS. 9 and 10 are electron micrographs of example emulsions.

The resulting emulsion consisted largely of high aspect ratio tabular grains, having a mean grain diameter of 4.5 μm, a mean thickness of 0.08 μm, an average aspect ratio of 56:1, and more than 80% of the total projected area of the emulsion grains consisted of tabular grains of a thickness 0.2 μm or less and an aspect ratio 5:1 or more. FIG. 9 is a 6000× electron micrograph of Emulsion 10B after dilution with water and separation of tabular grains by sedimentation for 24 hours.

EXAMPLE 11

This example illustrates the ability provided by the use of low methionine gelatin to prepare high aspect ratio tabular grain silver bromide Emulsion 11A at an even lower ambient bromide concentration than in Example 10. The emulsion was prepared at pBr 2.08.

The reaction vessel was charged with a total volume of 2 L, containing 30.0 g of the oxidized gelatin of the invention, and KBr to provide a pBr of 2.08, maintained at this value throughout the precipitation. The pH was adjusted to 5.6 at 40° C. The temperature was raised to 75° C., and with stirring a 1.0M $AgNO_3$ solution and a 1.0M KBr solution were added over a period of 1.0 min at a constant rate consuming 0.5% of the total silver used in the precipitation. The temperature was then raised at 3° C./min to 85° C. Addition of the $AgNO_3$ and KBr was then made at the same rate as previously for 0.5 min, consuming an additional 0.025% of the total silver used. Addition was then continued at a linearly accelerating rate (increasing at 0.24 mL/min/min) until the total of 1 mole of the $AgNO_3$ solution was consumed. The KBr solution was added throughout as required to maintain the pBr at 2.08.

An emulsion sample taken when the precipitation had consumed 0.25 mole Ag showed about 65% of the projected area of the emulsion grains to consist of tabular grains of thickness 0.2 μm or less and aspect ratio 5.1 or more. The mean grain diameter was 3.0 μm, mean grain thickness 0.05 μm, and average tabular grain aspect ratio 60:1. A sample taken at the end of the precipitation showed about 75% of the projected area of the grains to consist of tabular grains of thickness 0.2 μm or less and aspect ratio 5:1 or more. The mean grain diameter was 4.7 μm, mean grain thickness 0.09 μm and average aspect ratio 52:1.

EXAMPLE 12

This example illustrates the preparation of Emulsion 12A containing tabular silver bromide trapezoidal grains.

To 2.0 L of a solution containing 1.5% of the oxidized gelatin of the invention and 0.072M in KBr at 40° C., was added a 1.0M $AgNO_3$ solution at a constant rate over a period of 19 h, consuming 1.134 moles of silver. Simultaneously, a 1.14M KBr solution was added as required to maintain a pBr of 1.14. The emulsion was then washed by the process of Yutzy et al., U.S. Pat. No. 2,614,292.

Figure 10:
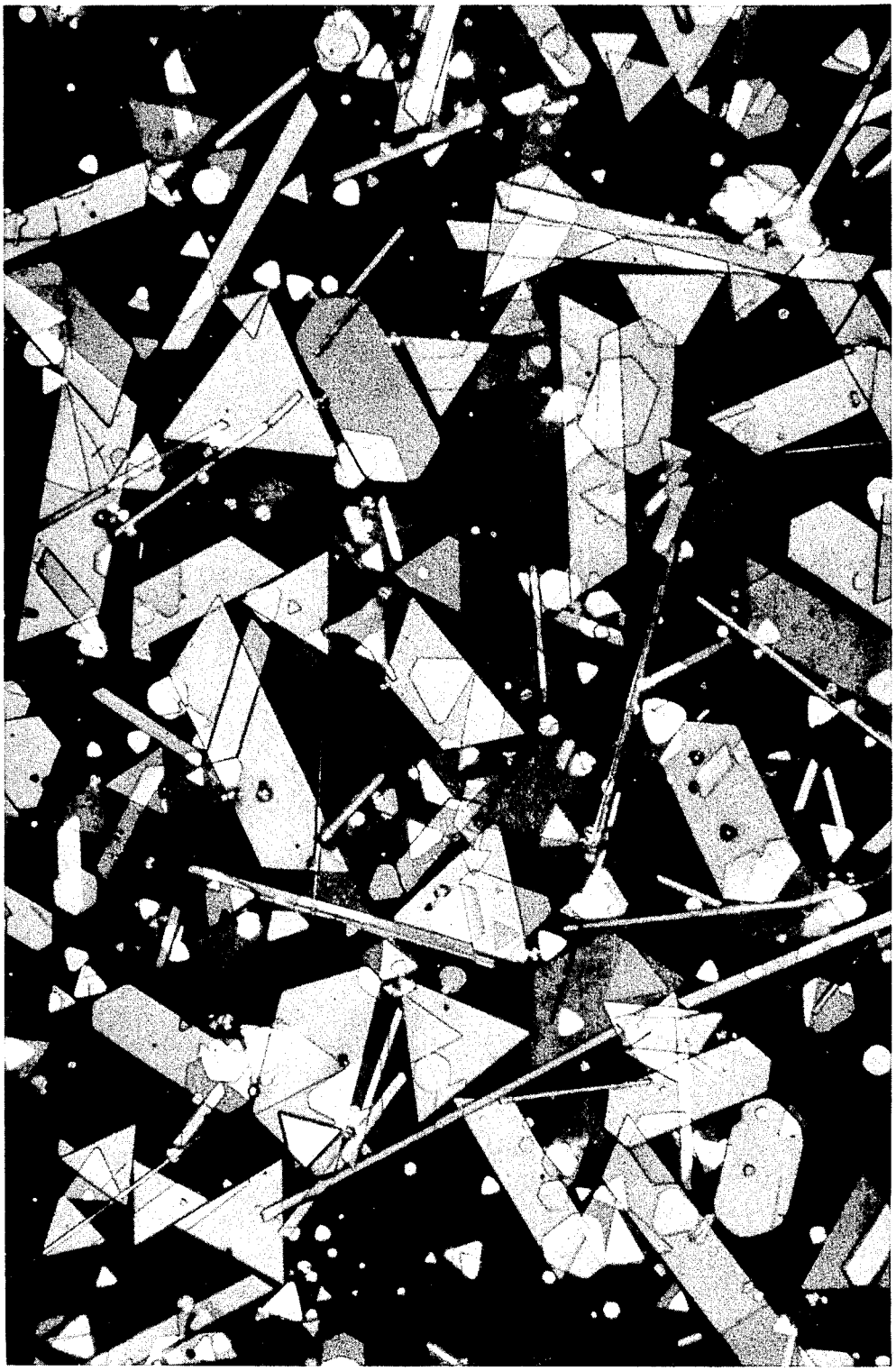

FIG. 10 is a 750× bright-field reflection photomicrograph showing a representative field of the resulting emulsion. More than 50% of the projected area consisted of tabular trapezoidal grains having an average size of about 45×10×0.16 μm. In addition, large triangular tabular grains were present, having an average edge length of about 20 μm and average thickness of about 0.16 μm, and believed to be derived from trapezoids. A minor population of smaller triangles and hexagons having an average equivalent circular diameter of about 9 μm was also present.

The invention has been described in detail with particular reference to preferred embodiments thereof, but it will be understood that variations and modifications can be effected within the spirit and scope of the invention.

What is claimed is:

1. A process for the precipitation of a thin tabular grain emulsion comprising
   concurrently introducing into a reaction vessel silver, bromide, and, optionally, iodide ions to form tabular grains of less than 0.2 μm in thickness and
   maintaining the tabular grains in suspension with a gelatino-peptizer,
   characterized in that the gelatino-peptizer contains less than 30 micromoles of methionine per gram.

2. A process according to claim 1 further characterized in that the gelatino-peptizer contains less than 12 micromoles of methionine per gram.

3. A process according to claim 2 further characterized in that the gelatino-peptizer contains less than 5 micromoles of methionine per gram.

4. A process according to claim 1 further characterized in that the pBr within the reaction vessel is maintained in the range of from 1.6 to 2.4 at the time that tabular grains are being formed.

5. A process according to claim 4 further characterized in that the pBr within the reaction vessel is maintained in the range of from 1.6 to 2.2 at the time the tabular grains are being formed.

6. A process according to claim 1 further characterized in that the gelatino-peptizer is treated with an oxidizing agent to lower its methionine content prior to concurrent introduction into the reaction vessel of silver and bromide ions.

7. A process according to claim 6 further characterized in that the gelatino-peptizer is treated with hydrogen peroxide to lower its methionine content.

8. A process according to claim 1 further characterized in that a thin tabular grain silver bromide emulsion in which tabular silver bromide grains having a thickness of less than 0.2 μm and an aspect ratio of greater than 5:1 account for greater than 50 percent of the total grain projected area is prepared by concurrently introducing silver and bromide ions into the reaction vessel while maintaining the pBr within the reaction vessel in the range of from 1.1 to 2.0.

9. A process according to claim 1 further characterized in that a thin tabular grain silver bromoiodide emulsion in which tabular silver bromoiodide grains having a thickness of less than 0.2 μm and an aspect ratio of greater than 5:1 account for greater than 50 percent of the total grain projected area is prepared by concurrently introducing silver, bromide, and iodide ions into the reaction vessel while maintaining the pBr within the reaction vessel in the range of from 1.1 to 2.0.

10. A thin tabular grain emulsion comprising
   tabular silver bromide or bromoiodide grains having a thickness of less than 0.2 μm and an aspect ratio of greater than 5:1 accounting for greater than 50 percent of the total grain projected area of said emulsion and
   a gelatino-peptizer containing less than 30 micromoles of methionine per gram.

11. A thin tabular grain emulsion according to claim 10 in which the gelatino-peptizer contains less than 12 micromoles of methionine per gram.

12. A thin tabular grain emulsion according to claim 10 in which the gelatino-peptizer contains less than 5 micromoles of methionine per gram.

13. A thin tabular grain emulsion according to claim 10 in which at least 2 percent of the total grain projected area is accounted for by thin tabular trapezoidal grains.

14. A thin tabular grain emulsion according to claim 13 in which at least 50 percent of the total grain projected area is accounted for by thin tabular trapezoidal grains.

15. A thin tabular grain emulsion according to claim 10 in which tabular silver bromide grains having a thickness of less than 0.2 μm and an aspect ratio of greater than 8:1 account for greater than 70 percent of the total grain projected area.

16. A thin tabular grain emulsion according to claim 10 in which said gelatino-peptizer consists essentially of gelatin and tabular silver bromide grains having a thickness of less than 0.2 μm and an aspect ratio of greater than 20:1 account for greater than 90 percent of the total grain projected area.

17. A thin tabular grain emulsion according to claim 10 in which tabular silver bromoiodide grains having a thickness of less than 0.2 μm and an aspect ratio of greater than 8:1 account for greater than 70 percent of the total grain projected area.

18. A thin tabular grain emulsion according to claim 10 in which said gelatino-peptizer consists essentially of gelatin and tabular silver bromoiodide grains having a thickness of less than 0.2 μm and an aspect ratio of greater than 20:1 account for greater than 90 percent of the total grain projected area.

* * * * *